US008171867B2

(12) United States Patent
Roche

(10) Patent No.: US 8,171,867 B2
(45) Date of Patent: May 8, 2012

(54) QUILTING AND EMBROIDERY METHOD

(75) Inventor: Eileen Roche, Flower Mound, TX (US)

(73) Assignee: Great Notions News, Inc., Dallas, TX (US)

( * ) Notice: Subject to any disclaimer, the term of this patent is extended or adjusted under 35 U.S.C. 154(b) by 415 days.

(21) Appl. No.: 12/498,970

(22) Filed: Jul. 7, 2009

(65) Prior Publication Data

US 2011/0005441 A1 Jan. 13, 2011

(51) Int. Cl.
*D05B 11/00* (2006.01)

(52) U.S. Cl. ..... 112/117

(58) Field of Classification Search ..... 112/103, 112/117, 470.01, 470.14, 475.18, 475.19, 112/119, 102.5; 38/102.2, 102.91
See application file for complete search history.

(56) References Cited

U.S. PATENT DOCUMENTS

| | | | | |
|---|---|---|---|---|
| 5,758,588 | A * | 6/1998 | Orfali | 112/475.08 |
| 6,445,970 | B1 * | 9/2002 | Hedman et al. | 700/138 |
| 6,871,605 | B1 * | 3/2005 | Zesch et al. | 112/475.01 |
| 6,875,395 | B2 * | 4/2005 | Kisha et al. | 264/482 |
| 6,983,192 | B2 * | 1/2006 | Block et al. | 700/138 |

* cited by examiner

*Primary Examiner* — Tejash Patel
(74) *Attorney, Agent, or Firm* — Afghani Law Firm; Kevin Afghani

(57) ABSTRACT

The present invention provides an improved method and computer program product for quilting and embroidering fabric. The method comprises securing a quilt sandwich of top layer fabric, batting and backing fabric in an embroidery hoop and attaching said embroidery hoop to an embroidery machine. The user retrieves a digitized embroidery file that is fed into the embroidery machine. The digitized file instructs the embroidery machine to stitch the quilt layers together according to a predetermined stippling pattern and to stitch an outline for an appliqué. After an appliqué fabric is placed over the outline, the digitized file sews a tackdown stitch, after which appliqué enhancements or additional layers of appliqué may also be stitched. The quilt is then removed from the embroidery hoop and the appliqué and quilt are trimmed.

18 Claims, 6 Drawing Sheets

QUILTING AND EMBROIDERY METHOD

TECHNICAL FIELD

The present invention relates generally to quilting and embroidering and more specifically to a method for reducing the number of steps required in quilting and speeding up production time.

BACKGROUND OF THE INVENTION

Quilting is a sewing method done either by hand, by sewing machine, or by a longarm quilting system. The process uses a needle and thread to join two or more layers of material together to make a quilt. Typical quilting is done with three layers: the top fabric or quilt top, batting (filler sandwiched between two layers of fabric to give the quilt loft) and backing material. The quilter's hand or sewing machine passes the needle and thread through all layers and then brings the needle back up. The process is repeated across the entire piece where quilting is desired. A straight or running stitch is commonly used, and these stitches can be purely functional or decorative and elaborate.

Quilting is done on bed spreads, art quilt wail hangings, clothing, and a variety of textile products. Quilting can make a project thick or use dense quilting to raise one area so that another stands out.

Traditional, quilting is a six-step process that includes: 1) selecting a pattern, fabrics and batting; 2) measuring and cutting fabrics to the correct, size to make blocks from the pattern; 3) piecing blocks together (sewing cut pieces of fabric together using a sewing machine or by hand to make blocks) to make a finished "top"; 4) layering the quilt top with batting and backing to make a "quilt sandwich"; 5) quilting by hand or machine through all layers of the quilt sandwich; and 6) squaring up and trimming excess batting from the edges, machine sewing the binding to the front edges of the quilt and then hand-stitching the binding to the quilt backing. It should be noted, that if the quilt will, be hung on the wall, there is an additional step: making and attaching the hanging sleeve. For high volume operations, this multitude of steps is very labor and time intensive.

Therefore, it would be desirable to have a method of quilting that reduces the number of steps involved and speeds up production time.

SUMMARY OF THE INVENTION

The present invention provides an improved method and computer program product for quilting and embroidering fabric. The method comprises securing a quilt sandwich of top layer fabric, batting and backing fabric in an embroidery hoop and attaching said embroidery hoop to an embroidery machine. The user retrieves a digitized embroidery file that is fed into the embroidery machine. The digitized file instructs the embroidery machine to first stitch the quilt layers together according to a predetermined stippling pattern. The digitized file then instructs the embroidery machine to stitch an outline for an appliqué. Alternatively, the appliqué outline may be stitched before the stippling. After an appliqué fabric is placed over the outline, the digitized file sews a tackdown stitch, after which appliqué enhancements or additional layers of appliqué may also be stitched. The quilt is then removed from the embroidery hoop and the appliqué and quilt are trimmed. The invention allows all stitching and quilting to be completed before removing the quilt from the embroidery hoop and trimming the appliqué.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 1:
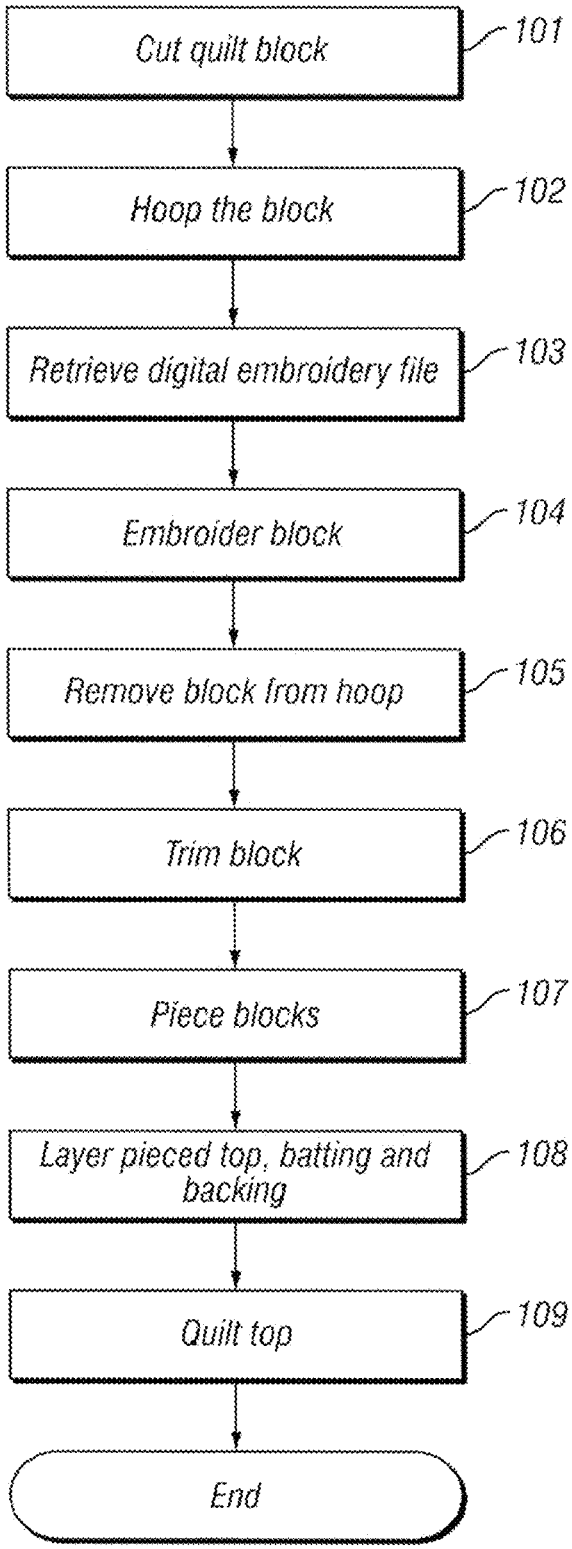
FIG. 1 (Prior Art)
FIG. 1 is a flowchart illustrating a method of quilting using embroidered blocks in accordance with the prior art.

Referring now to FIG. 1, a flowchart illustrates a method of quilting using embroidered blocks in accordance with the prior art. The process begins by cutting the quilt block larger than the required finished size (step 101). Next, the block is secured in an embroidery hoop with a stabilizer (step 102).

The user then retrieves a digital embroidery file on a computerized embroidery machine (step 103). The digitized file instructs the embroidery machine to embroider the decorative elements (e.g., embroidery designs, appliqué designs or foundation-piecing) (step 104).

After the block is embroidered, it is removed from the hoop (step 105) and trimmed to the finished size plus seam allowance (step 106). The blocks are then pieced together to create the quilt top (step 107).

The pieced quilt top, batting and backing are layered (step 108) and the layers are quilted together with running stitches (stippling) using a standard sewing machine or by hand (step 109).

Figure 2:
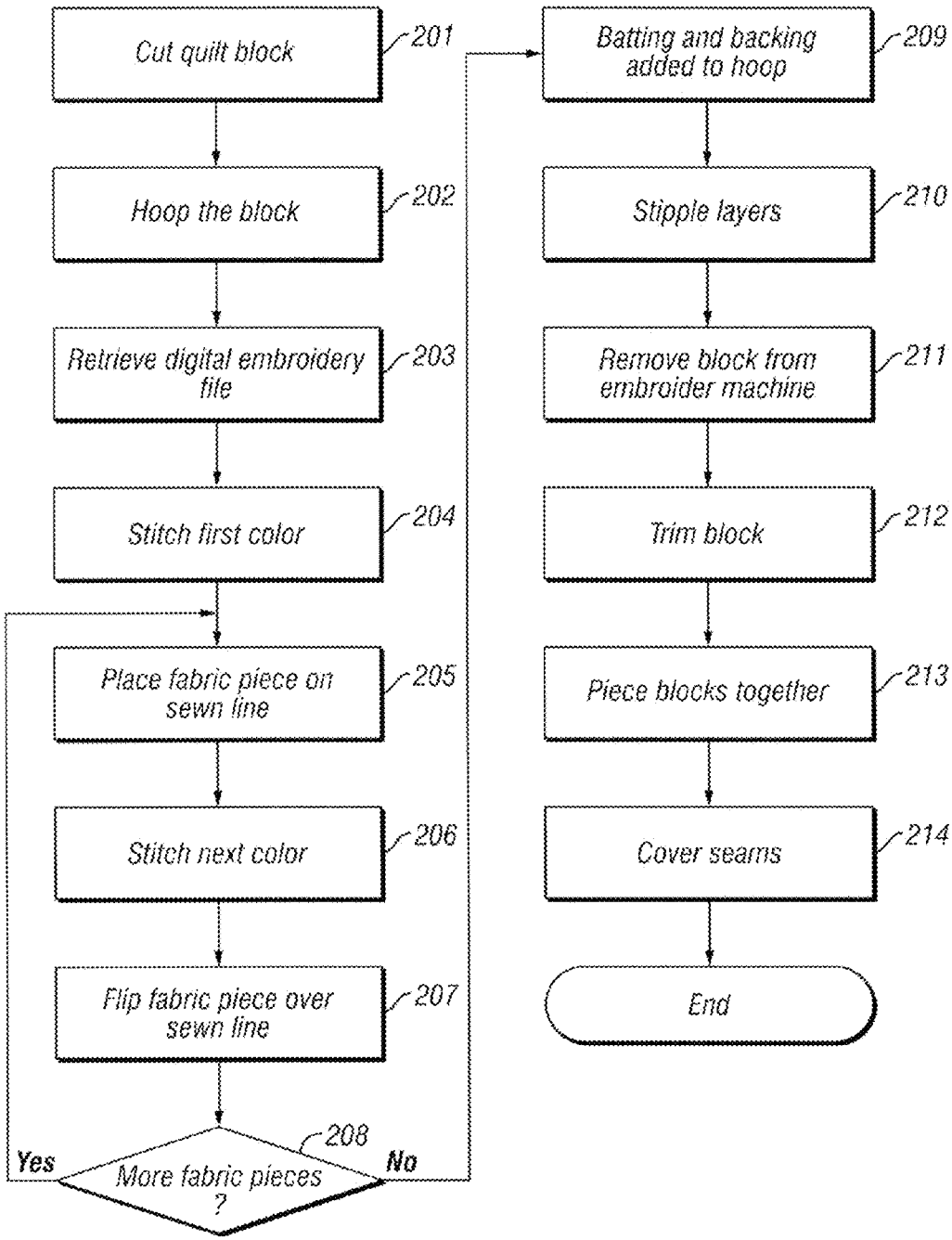
FIG. 2 (Prior Art)
FIG. 2 is a flowchart showing a method for quilting using foundation piecing in accordance with the prior art.

FIG. 2 is a flowchart showing a method for quilting using foundation piecing in accordance with the prior art. This method begins by cutting the quilt block foundation larger than the finished block size (step 201) and securing the foundation in an embroidery hoop with stabilizer (step 202).

The user then retrieves a digital embroidery file, which is an outline designating where fabric pieces are to be placed on by one (step 203). The digitized file instructs the embroidery machine to stitch the first color (outline) (step 204). The user places the first fabric piece right side down on the designated sewn line (step 205) and stitches the next color according to the digitized file (step 206). The fabric is then flipped down over the sewn line, and the seam is finger pressed (step 207).

If there are additional fabric pieces to be added to the block (step 208), steps 205-207 are repeated until the block is finished.

After the block is created, backing and batting can be added to the wrong side of the hoop and secured with temporary spray adhesive or a water soluble thread (step 209). The final colors of the digital embroidery file stipple the three layers (step 210). The finished block is removed from the machine (step 211) and trimmed to the desired size (step 212).

The blocks are then pieced together with a narrow seam allowance (step 213). A ribbon or narrow strip of fabric is fused to the back of the quilt, covering the seams, and secured with a topstitch (step 214).

Figure 3:
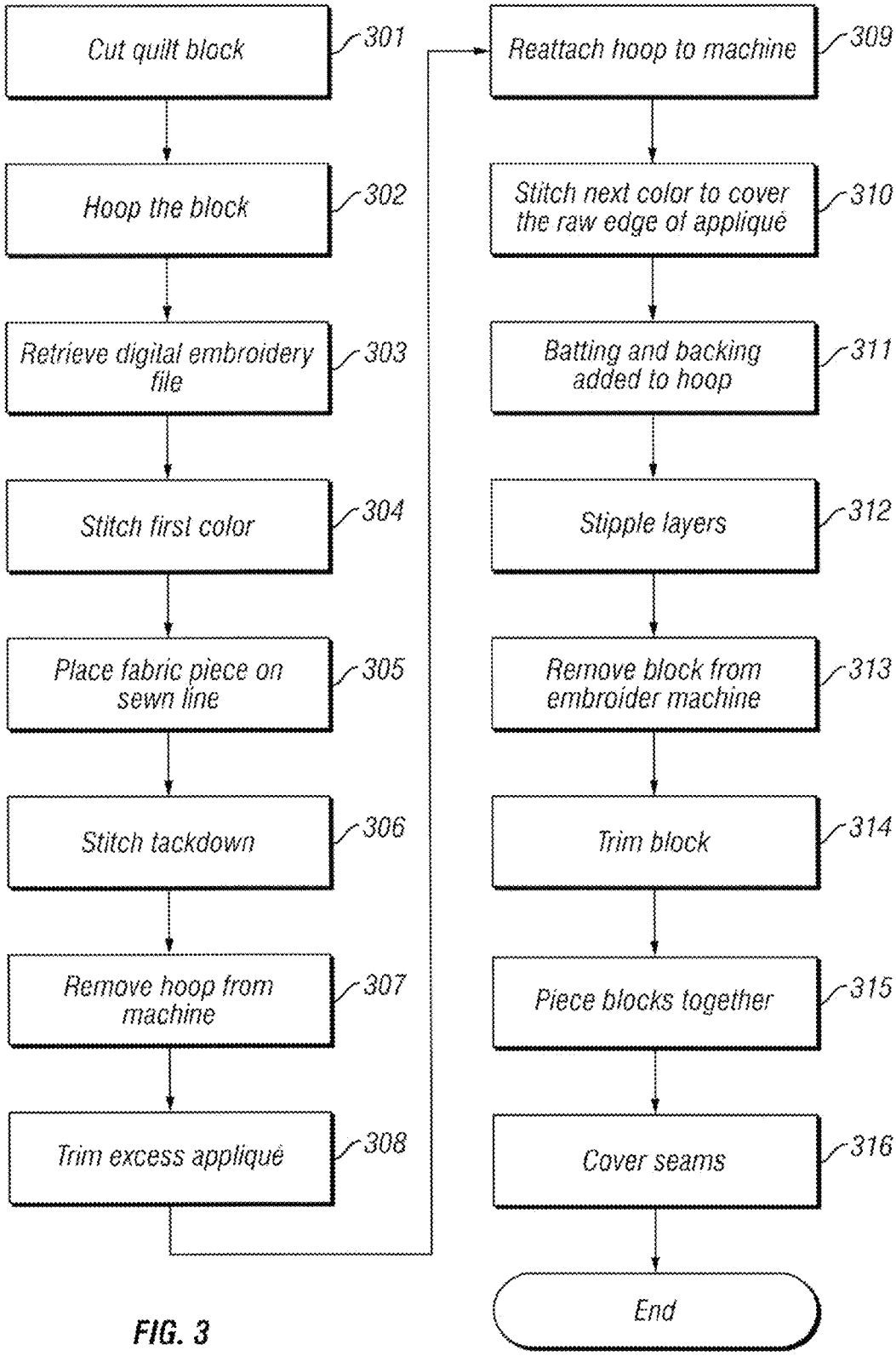
FIG. 3 (Prior Art)
FIG. 3 is a flowchart showing yet another prior art method of quilting involving the use of machine embroidery appliqué.

FIG. 3 is a flowchart showing yet another prior art method of quilting involving the use of machine embroidery appliqué. This method is a variation of the method shown in FIG. 2. The process begins by cutting the quilt block larger than the required finished size (step 301) and securing it in an embroidery hoop with a stabilizer (step 302).

The user retrieves a digital embroidery file that provides the outline of where to place the appliqué fabric (step 303) and stitches the first color according to the digitized file (step 304). The fabric is placed right side up, covering the sewn outline (step 305), and the tackdown is stitched (step 306).

At this point, the hoop is removed from the embroidery machine, while leaving the fabric in the hoop (step 307), and the excess appliqué fabric is trimmed (step 308). The user then reattaches the hoop to the embroidery machine (step 309). The next color is then stitched, typically a satin stitch that covers the raw edge of the appliqué fabric (step 310).

After the block is created, backing and batting can be added to the wrong side of the hoop and secured with temporary spray adhesive or a water soluble thread (step 311). The final colors of the digital embroidery file stipple the three layers (step 312). The user removes the finished block from the machine (step 313) and trims it to the desired size (step 314).

The blocks are pieced together with a narrow seam allowance (step 315), and a ribbon or narrow strip of fabric is fused to the back of the quilt, covering the seams and secured with a topstitch (step 316).

As is obvious from the above descriptions, the prior art methods of quilting can be rather labor and time intensive. In addition, the user has to remove the hoop from the machine to trim the appliqué fabric and then reattach the hoop to the machine and complete the design. Removing and reattaching the hoop in this manner can cause misalignment within the embroidery machine and is time consuming. The present invention overcomes these disadvantages by changing the sequencing of the steps during the embroidery process and reducing the number of steps and time involved in quilting as well as eliminating the potential misalignment issues noted above.

Figure 4:
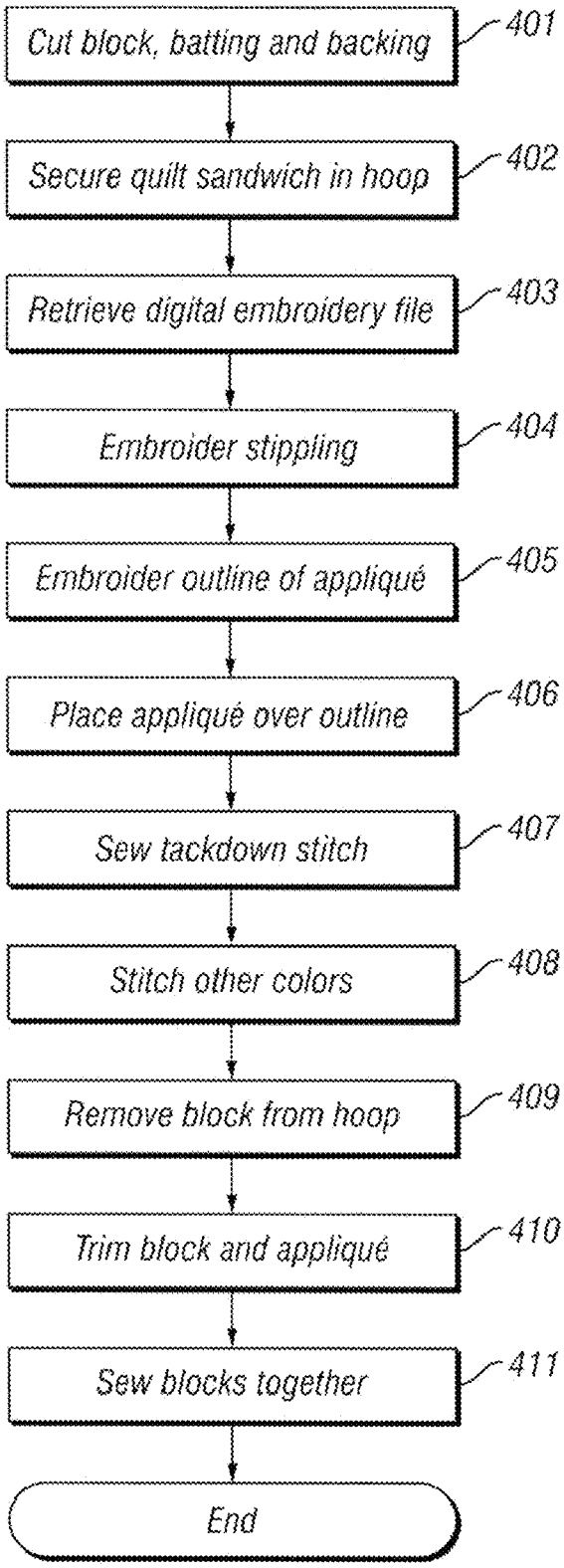
FIG. 4 is a flowchart showing a quilting method in accordance with a preferred embodiment of the present invention.

FIG. 4 is a flowchart showing a quilting method in accordance with a preferred embodiment of the present invention. The process begins by cutting the block, batting and backing larger than the desired finished size (step 401) and seeming all of the layers of the quilt sandwich in an embroidery hoop (step 402). The user then retrieves and executes a digital embroidery file (step 403).

Figure 5A:
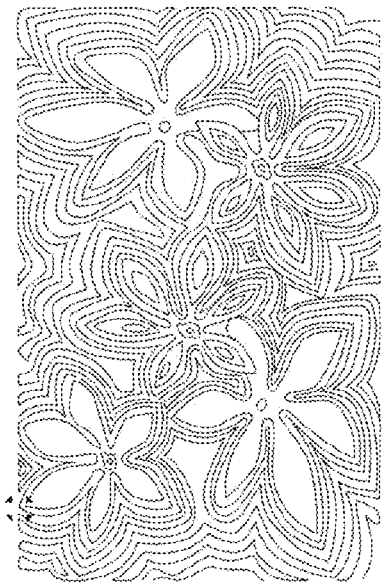
FIGS. 5A and 5B show examples stippling in straight lines or a meandering style, respectively.
Figure 5B:
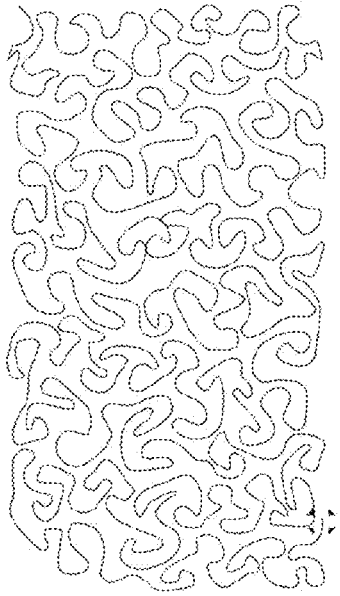

The digitized file first instructs the embroidery machine to embroider the stippling stitches to quilt the layers together (step 404). FIGS. 5A and 5B show examples of stippling in straight lines or a meandering style, respectively.

Figure 6A:
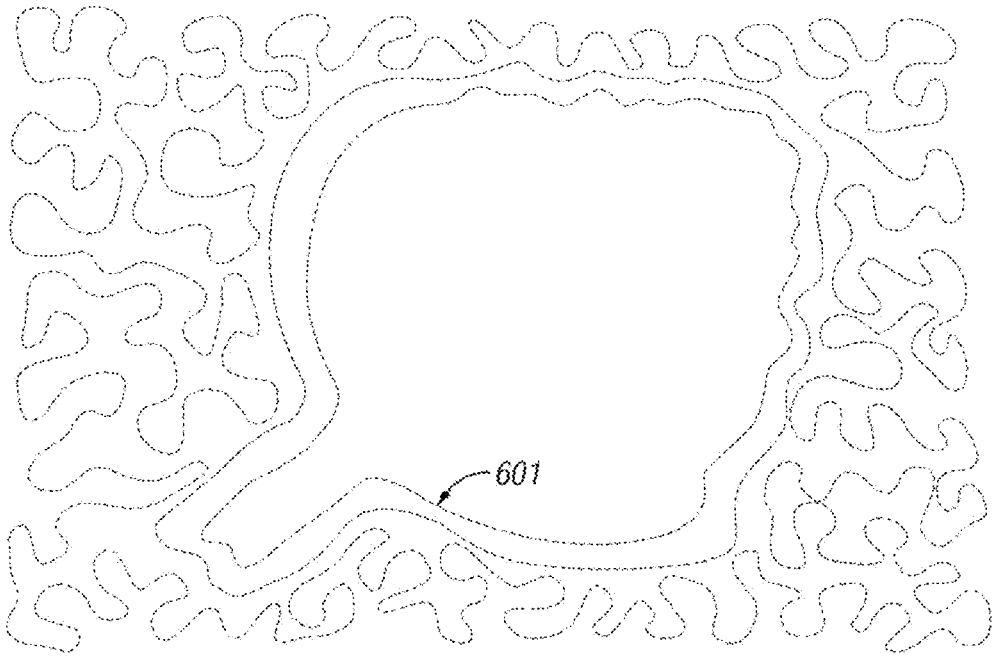
FIG. 6A shows an example of an appliqué outline within the stippling pattern.

The next stitch embroidered from the digitized file is the outline of the appliqué area sewn on the top layer of the quilt (step 405). FIG. 6A shows an example of an appliqué outline 601 within the stippling pattern. This is a placement guide to show where to place the appliqué fabric. It should be noted that this step is optional, as the user could place the fabric over the entire hoop without the outline.

Alternatively, steps 405 and 404 can be reversed. The appliqué outline can be sewn first and the stippling sewn after. The key element is that both the stippling and appliqué outline are sewn before the tackdown.

Figure 6B:
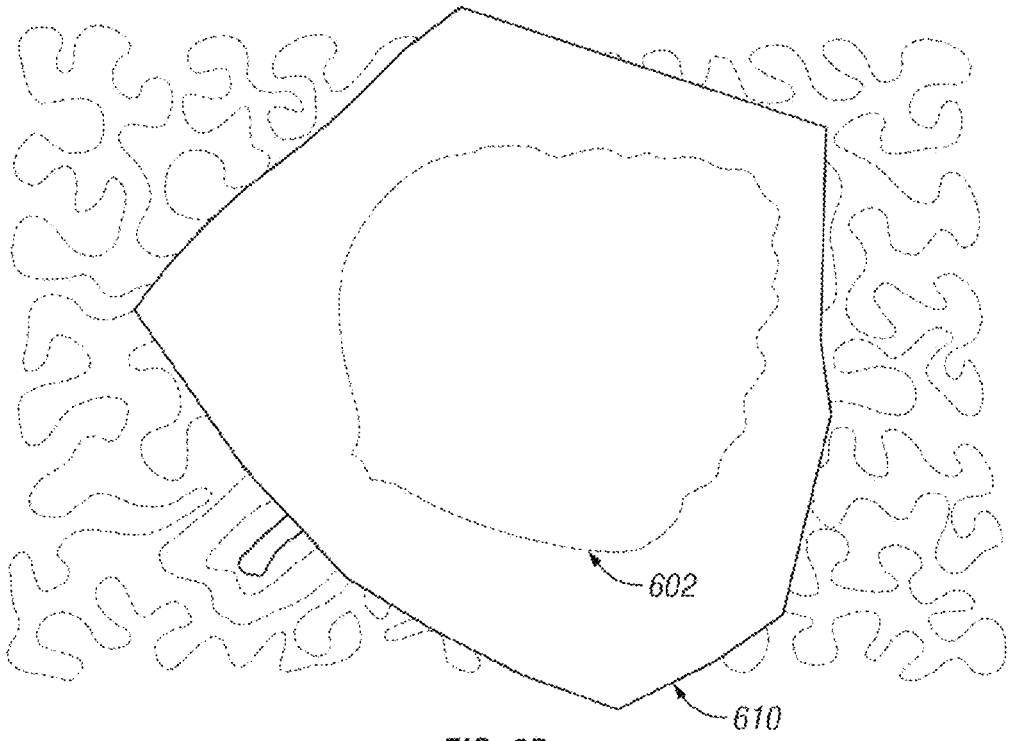
FIG. 6B shows a tackdown stitch sewn into an appliqué layer.
Figure 6C:
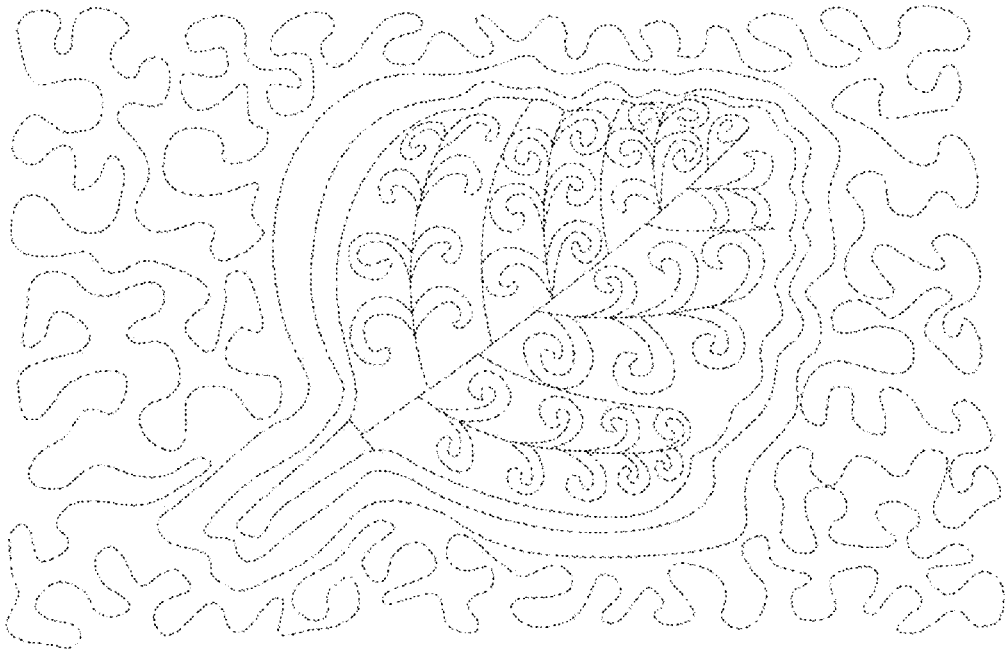
FIG. 6C shows an example of appliqué enhancements.

The user places the appliqué fabric over the designated area (step 406). The digitized file then sews a tackdown stitch to secure the appliqué fabric to the base fabric (step 407). FIG. 6B shows a tackdown stitch 602 sewn into an appliqué layer 610. Optionally, the digitized file may stitch other colors, which are aesthetic options such as, e.g., appliqué enhancements or additional layers of appliqué (step 408). FIG. 6C shows an example of appliqué enhancements.

The block is removed from the hoop (step 409), and the block is trimmed to the desired finished size plus a seam allowance, and the appliqué fabric is trimmed as well (step 410). The blocks are then sewn together using a reversible seaming method (step 411).

The advantage of the present invention over the prior art is that quilt blocks can be created faster and quilted all in one step (50% faster or more). In the prior art, one would normally have to create the quilt block first (decorate with appliqué), piece the blocks together and then quilt (stipple) the entire quilt. With the present invention, the blocks are already appliquéd and quilted when they are taken out of the hoop. The only thing left to do is sew the blocks together.

In the present invention all steps (appliquéing and quilting) are performed in one hooping. The appliqué fabric is applied after the quilting and outline stitches are sewn. The sequence of stitches enables the trimming to be completed after the quilt is removed from the hoop, thereby eliminates the risk of misalignment since there is no need to remove the hoop from the machine during the embroidery and quilting process.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A computer program product in a computer readable medium for use with a computerized embroidery machine, the computer program product comprising:

instructions for activating a digitized embroidery file that provides sewing pattern instructions;

instructions for sewing a stippling pattern to stitch together layers of a quilt sandwich placed in an embroidery hoop within the embroidery machine;

instructions for sewing an appliqué outline on said quilt sandwich; and instructions for sewing appliqué tackdown stitches for an appliqué after said stippling pattern and appliqué outline have been sewn and after the appliqué has been placed on the quilt sandwich;

wherein the quilt sandwich is secured in the embroidery hoop while, the instructions for sewing the stippling pattern to stitch together layers of said quilt sandwich, the instructions for sewing the appliqué outline on said quilt sandwich, and the instructions for sewing appliqué tackdown stitches for the appliqué are performed.

2. The computer program product according to claim 1, further comprising:

instructions for sewing appliqué enhancement patterns after the tackdown stitches.

3. The computer program product according to claim 1, further comprising:

instructions for sewing tackdown stitches for multiple appliqué layers.

4. A method of quilting and embroidering fabric, comprising the following sequence of steps:

(a) securing a quilt sandwich in an embroidery hoop and attaching said embroidery hoop to an embroidery machine;

(b) activating a digitized embroidery file that provides sewing pattern instructions to said embroidery machine;

(c) stitching together the layers of said quilt sandwich according to a stippling pattern contained in said digitized embroidery file;

(d) placing appliqué fabric over the quilt sandwich;

(e) sewing tackdown stitches for said appliqué fabric according to a tackdown pattern contained in said digitized embroidery file, wherein steps (b), (c), (d), and (e) are performable without removing the embroidery hoop from the embroidery machine;

(f) removing the quilt sandwich from the embroidery hoop; and (g) trimming the appliqué fabric and quilt sandwich.

5. The method according to claim 4, wherein step (c) further comprises sewing an appliqué outline according to an outline pattern contained in said digitized embroidery file.

6. The method according to claim 4, wherein step (e) further comprises sewing appliqué enhancements after sewing the tackdown stitches.

7. The method according to claim 4, further comprising after step (e) placing additional appliqué layers on said quilt sandwich and sewing tackdown stitches for the additional appliqué layers according to tackdown patterns in said digitized embroidery file.

8. The computer program product according to claim 1, wherein the quilt sandwich is removable from the embroidery hoop after the instructions for sewing the stippling pattern to stitch together layers of said quilt sandwich, the instructions for sewing the appliqué outline on said quilt sandwich, and the instructions for sewing appliqué tackdown stitches for appliqué are performed; and wherein the appliqué and the quilt sandwich are trimmable after the instructions for sewing the stippling pattern to stitch together layers of said quilt sandwich, the instructions for sewing the appliqué outline on said quilt sandwich, and the instructions for sewing appliqué tackdown stitches for the appliqué are performed.

9. The computer program product according to claim 1 wherein the embroidery hoop is connected to the embroidery machine while the instructions for sewing the stippling pattern to stitch together layers of said quilt sandwich, the instructions for sewing the appliqué outline on said quilt sandwich, and the instructions for sewing appliqué tackdown stitches for the appliqué are performed.

10. The computer program product according to claim 9, wherein the embroidery hoop is also connected to the embroidery machine while the instructions for activating the digitized embroidery file that provides sewing pattern instructions are performed.

11. The computer program product according to claim 1, wherein the quilt, sandwich is securable in the embroidery hoop while the instructions for activating the digitized embroidery file that provides sewing pattern instructions are performed.

12. The method according to claim 4, wherein the quilt sandwich is secured in the embroidery hoop during steps (b), (c), (d), and (e).

13. The method according to claim 4, wherein the embroidery hoop is connected to the embroidery machine during steps (b), (c), (d), and (e); and wherein the quilt sandwich is secured in the embroidery hoop during steps (b), (c), (d), and (e).

14. The method according to claim 7, wherein the step of placing additional appliqué layers on said quilt sandwich and sewing tackdown stitches for the additional appliqué layers according to tackdown patterns in said digitized embroidery file is also performable without removing the embroidery hoop from the embroidery machine.

15. A method of quilting and embroidering fabric, comprising:

(a) securing a quilt sandwich in an embroidery hoop and attaching said embroidery hoop to an embroidery machine;

(b) activating a digitized embroidery file that provides sewing pattern instructions to said embroidery machine;

(c) stitching together the layers of said quilt sandwich according to a stippling pattern contained in said digitized embroidery file;

(d) placing an appliqué over the quilt sandwich; and (e) sewing tackdown stitches for said appliqué according to a tackdown pattern contained in said digitized embroidery file, wherein the embroidery hoop is connected to the embroidery machine during steps (b), (c), (d), and (e).

16. The method according to claim 15, wherein the quilt sandwich is secured in the embroidery hoop during steps (b), (c), (d), and (e).

17. The method according to claim 15, further comprising:

removing the quilt sandwich from the embroidery hoop; and trimming the appliqué and quilt sandwich.

18. The method according to claim 15, wherein steps (b), (c), (d), and (e) are performable without removing the embroidery hoop from the embroidery machine and without removing the quilt sandwich from the embroidery hoop.

* * * * *